United States Patent [19]

Monteiro

[11] Patent Number: 4,555,108

[45] Date of Patent: Nov. 26, 1985

[54] EXERCISING AND PHYSICAL-CONDITIONING APPARATUS

[76] Inventor: Frank G. Monteiro, 599 Marquette Cir., Costa Mesa, Calif. 92626

[21] Appl. No.: 588,804

[22] Filed: Mar. 12, 1984

[51] Int. Cl.[4] ..... A63B 23/06

[52] U.S. Cl. ..... 272/69; 272/1 E; 272/130; 128/25 B

[58] Field of Search ..... 272/69, 70, 70.2, 96, 272/127, 1 E, 1 B, 130; 128/25 B

[56] References Cited

U.S. PATENT DOCUMENTS

| | | | |
|---|---|---|---|
| 2,042,764 | 6/1936 | Birch | 272/69 |
| 3,260,523 | 7/1966 | Brown | 272/1 E |
| 3,497,215 | 2/1970 | Harrison et al. | 272/69 |
| 3,592,466 | 7/1971 | Parsons | 272/69 |
| 3,633,905 | 1/1972 | Etchelecou | 272/1 E |

*Primary Examiner*—Richard J. Apley
*Assistant Examiner*—David J. Brown
*Attorney, Agent, or Firm*—Francis X. LoJacono

[57] ABSTRACT

The present invention discloses an exercising apparatus designed to simulate the climbing of a staircase to achieve physical conditioning, including improved cardiopulmonary function and muscle-tone of the lower extremities. The present apparatus comprises a base-support structure on which is rotatably supported a stair mechanism defined by a rotatable member provided with two sets of step members. A plurality of left-step members and a plurality of right-step members are alternately offset from each other circumferentially to allow a step-climbing action by the operator. A gear drive is interconnected to a hydraulic system, the gear drive being operated by the rotation of the stair mechanism, which in turn operates the hydraulic system that includes a flow-control valve for regulating the rotation of the steps to suit the requirements of the individual operator.

7 Claims, 4 Drawing Figures

EXERCISING AND PHYSICAL-CONDITIONING APPARATUS

BACKGROUND OF THE INVENTION

This invention relates generally to exercising devices, and more particularly to an exercising and physical-conditioning apparatus to improve overall stamina, cardiopulmonary function, and muscle tone of the lower body and legs.

The present apparatus is designed to substantially simulate the ascending of a staircase so as to establish the same physical exertion required in climbing a large number of stairs. At present, the only available device that provides similar physical reaction and stress is the well-known treadmill apparatus.

However, the treadmill is designed mainly to create a walking exercise at selective speeds, thus providing a different physical exertion from that of the present invention. Generally, there are two types of treadmills, one which is driven by the person who is performing the walking exercise and the other which is a controlled motor-driven apparatus that is employed basically for medical examinations and physiological studies. Each unit, however, includes a continuous conveyor-type belt that moves longitudinally over a platform and is supported by at least two drum members.

SUMMARY OF THE INVENTION

The present invention has for an important object to provide an exercising apparatus as well as a physical-conditioning device designed to simulate the climbing of stairs.

Still another object of the present invention is to provide an exercising apparatus that includes a raised base unit that rotationally supports a plurality of steps or treads that respond to the individual's weight together with the downward physical action of the body motion.

Another object of the present invention is to provide an exercising apparatus of this type that includes a hydraulically controlled system to regulate the speed, action and ease at which the steps rotate, so that the person using the apparatus can regulate the rotation thereof to accommodate for his or her own physical capacity. Thus, by controlling the force required to rotate the steps about a central axis, one controls the needed force that must be exerted to accomplish the desired physiological body reaction.

It is still another object of the invention to provide an apparatus of this character with an easily adjustable control system.

It is a further object of the present invention to provide a rotary-type apparatus of this character that is designed to have relatively few yet simple operating parts.

It is still a further object of the invention to provide a physical-exercising device of this type that promotes health and stamina.

Still another object of the present invention is to provide an apparatus of this character that is easy to operate, service and maintain, and that is relatively inexpensive to manufacture.

It is still another object of the invention to provide an exercising device of this character that is not only simple but is also durable in construction, so as to be long-lasting.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only, and in which identical reference numerals will refer to like parts in the various views.

DETAILED DESCRIPTION OF THE INVENTION

Figure 1:
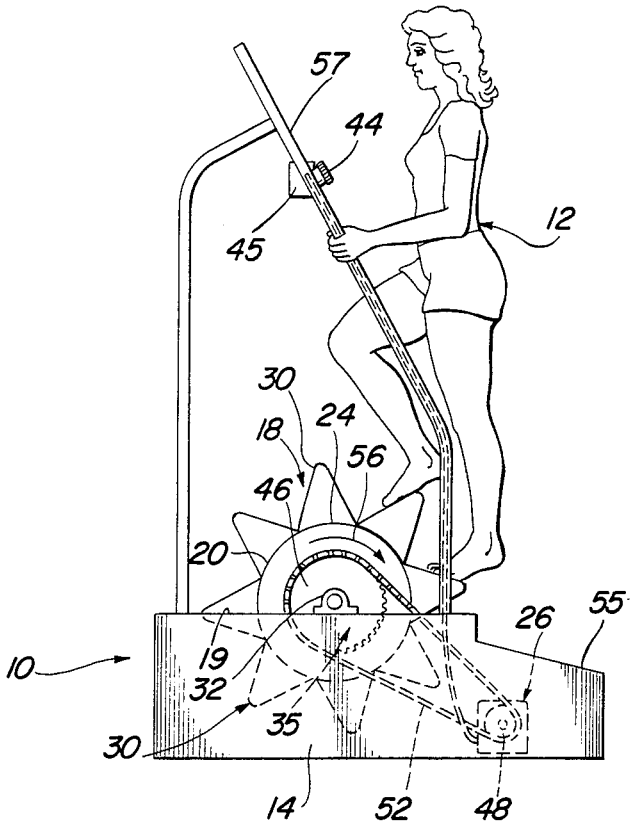
FIG. 1 is a side-elevational view of the present invention, showing the apparatus being employed in the manner that provides a unique exercising apparatus which simulates the ascending of staircase.
Figure 2:
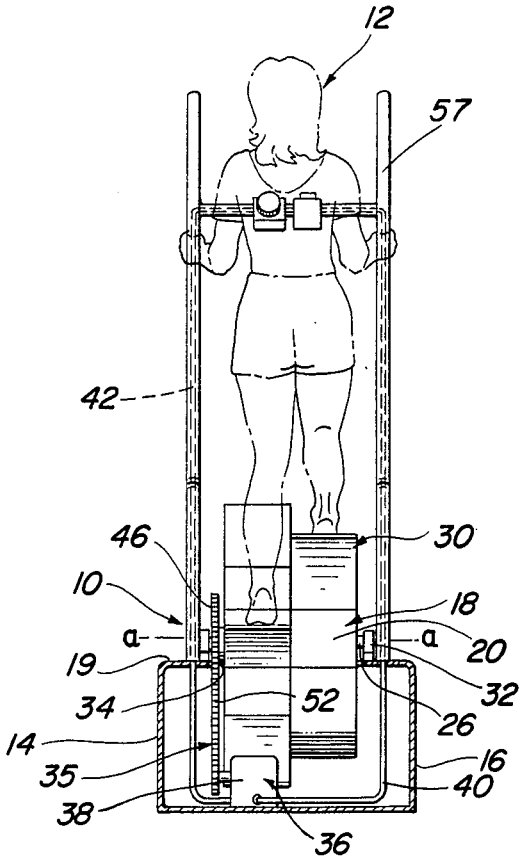
FIG. 2 is a front-elevational view having the base support housing broken away for clarity.

Referring more particularly to FIGS. 1 and 2, there is shown an exercising apparatus, generally indicated at 10, on which there is illustrated an individual 12 positioned in a typical operational manner.

As mentioned above, the present invention is specifically designed to establish a physical reaction simulating the ascending of a staircase, whereby the heart and leg muscles especially are conditioned in the same way as when one climbs a flight of stairs.

The present exercising apparatus comprises a base support structure 14 which can be constructed in many suitable arrangements, but is herein shown having an internal structural framework 14 which is covered by a housing 16.

Figure 3:
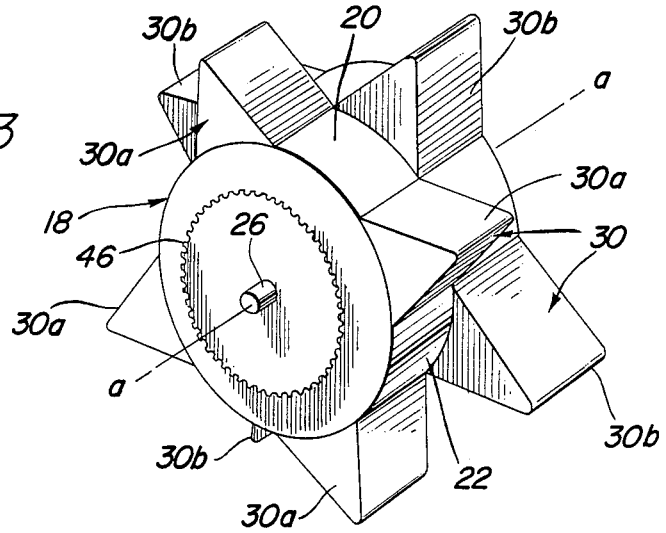
FIG. 3 is a perspective view, showing the two sets of treads mounted to a support drum.
Figure 4:
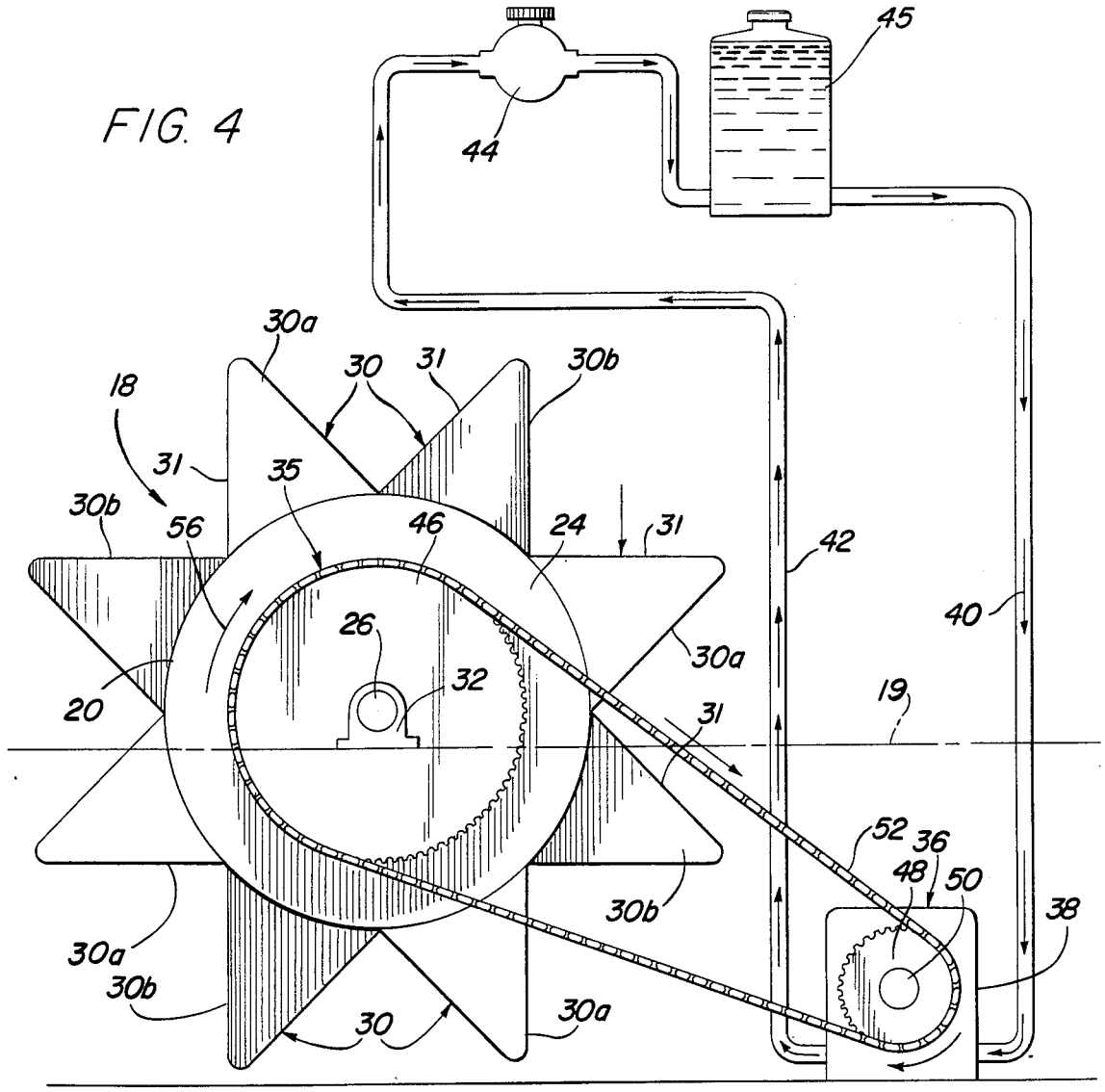
FIG. 4 is a diagrammatic view, showing the controlled hydraulic system used in combination with the drive mechanism.

Housing 16 and its framework 14 are adapted to support a rotatable stair means, indicated generally at 18, the stair means being mounted to the upper platform 19 so as to rotate about its horizontal axis a—a, as seen in FIGS. 2 and 3. The stair means may be formed in a variety of suitable configurations. However, the preferred construction as herein shown comprises a drum-like rotatable structural member 20 having a cylindrical wall 22 and opposite side walls 24 through which extends a central shaft 26, whereby horizontal axis a—a is further defined.

Mounted about rotatable structural member 20 is a plurality of step members 30 which project readially outward from rotatable structural member 20 and axis a—a. Each step member 30 is shown having a triangular configuration. However, various arrangements may be provided as long as the tread plate 31 of step 30 is affixed to the rotational structure member 20, so that tread plate 31 is positionable in a substantially horizontal plane with respect to the upper platform 19 of housing 16 during rotation about axis a—a. This allows for a very stable footing for the user as the steps rotate in a downwardly sloping direction.

The steps are arranged in two groups or sets—a left set for the engagement and support of the left foot of the user and a right set for the engagement and support of the right foot, the left set being indicated by numeral 30*a* and the right set being designated by 30*b*.

In the preferred embodiment of the invention, each set of steps comprises four steps 30 that are equally spaced about the rotatable structural member 20—that is, they are positioned at 90° from each other. Further, the sets of steps are offset from each other at 45°. Hence, right steps 30*b* are adjacent to the left steps 30*a*, but are arranged so as to be positioned intermediate each other.

Due to the particular positioning of the two sets or groups of steps, the user thereof is only required to move in a normal treading gait by raising one leg at a time, as when climbing a typical staircase.

Accordingly, stair means 18 is rotatably supported by a bearing support means 32 in which the extended ends of shaft 26 are journaled. The bearing means may be provided by any suitable bearing-support member. Thus, bearing members 32 are secured to upper platform 19 and are positioned on opposite sides of opening 34 which defines a well adapted to receive the extended step members as they are rotated about axis a—a.

The present invention further includes a drive means, generally designated at 35, which is adapted to drive a hydraulically controlled system which defines a rotational control means 36. This hydraulic system comprises a hydraulic pump or motor 38 (such as a Char-Lynn orbit motor, P103–1027), an inlet-flow line 40, an outlet-flow line 42, a flow-control valve 44, and a reservoir 45.

Motor or pump 38 is operably connected to drive means 35. The drive means comprises an enlarged gear 46 which is fixedly secured to shaft 26, and a reduced-diameter gear 48 which is mounted to shaft 50 of pump 38, the two gears 46 and 48 being interconnected by a drive chain 52.

Thus, in order to operate the present apparatus, an individual (represented by 12 in FIGS. 1 and 2) mounts the sloping platform 55 and grasps hand rails 56 which provide a support means for operator 12, who then proceeds to lift his or her feet alternately on the respective steps. The weight of the individual plus the downward force applied by each leg will cause the stair means 18 to rotate in the direction of arrow 56, whereby pump 38 is activated to cause fluid to flow from reservoir 45, into line 40, and then forced into outlet line 42.

Prior to returning to reservoir 45, the fluid flow must pass through flow-control valve 44. By adjusting valve 44, the operator can control not only the speed of rotation of the steps but also the force that must be applied thereto. Accordingly, the flow-through valve 44 is adjustably restricted. This type of physical activity requires that the individual lift his or her body upwardly, one leg at a time, as indicated in FIGS. 1 and 2, in a very similar manner to climbing a flight of stairs. Therefore, such an exercise affects not only the leg structures and muscles, but the cardiopulmonary function as well.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An exercising and physical-conditioning apparatus that provides a means for simulating the climbing of stairs, the apparatus comprising:

a base-support structure;

a rotatable stair means supported on said base-support structure for rotation about a horizontal axis;

a hydraulic-control means operably connected to said rotatable stair means, whereby the rotation thereof is selectively operable;

drive means interconnecting said rotatable stair means and said hydraulic-control means, said hydraulic-control means being activated by the rotation of said stair means, and the rotation of said stair means being provided by the treading action of the operator engaged thereon;

wherein said rotational stair means comprises:

a rotatable structural member having extending horizontal shaft members defining said horizontal axis thereof;

bearing means mounted to said base-support structure, and adapted to receive said shaft members for rotation therein; and a plurality of step members fixedly secured to said rotatable structural member, and positioned to extend radially outward from said horizontal axis thereof.

2. An exercising and physical-conditioning apparatus as recited in claim 1, wherein said plurality of step members include a first and a second set of step members, said first and second sets being juxtaposed as well as offset from each other.

3. An exercising and physical-conditioning apparatus as recited in claim 2, wherein:

said first set of step members is arranged to be engaged by the left foot of said operator;

said second set of step members is arranged to be engaged by the right foot of said operator;

said step members of said first set are equally spaced about said rotatable structure;

said step members of said second set are equally spaced about said rotatable structure; and said step members of each of said sets are offset so as to be positioned intermediate each other, whereby a normal treading gait can be employed by said operator for both the left and the right foot engagement of the respective step members.

4. An exercising and physical-conditioning apparatus as recited in claim 3, wherein said hydraulic-control means comprises:

a hydraulic motor operably connected to said drive means;

a reservoir;

an inlet-flow line connected between said reservoir and said hydraulic motor;

an outlet-flow line connected between said motor and said reservoir; and a valve-flow-control means disposed in said outlet-flow line, to control the flow of fluid between said motor and said reservoir, whereby the rotation of said step members is controlled by said interconnecting drive means.

5. An exercising and physical-conditioning apparatus as recited in claim 4, wherein said drive means comprises:

a first, enlarged-diameter, gear member secured to said rotatable structural member;

a second, reduced-diameter, gear member secured to said hydraulic motor; and a chain interconnecting said gear members, whereby said motor is activated by the rotation of said rotatable structural member.

6. An exercising apparatus as recited in claim 3, including means for supporting said operator in an upright treading position.

7. An exercising apparatus as recited in claim 6, wherein said support means comprises a plurality of hand-rail members fixedly mounted to said base-support structure, whereby said operator may grasp said hand rails while operating said apparatus.

* * * * *